US005353583A

United States Patent [19]

Tanae et al.

[11] Patent Number: 5,353,583

[45] Date of Patent: Oct. 11, 1994

[54] APPARATUS FOR HEAT TREATING SYNTHETIC YARN

[75] Inventors: Fumio Tanae, Iyo; Shunzo Naito, Matsuyama, both of Japan

[73] Assignee: Teijin Seiki Co., Ltd., Osaka, Japan

[21] Appl. No.: 32,559

[22] Filed: Mar. 17, 1993

Related U.S. Application Data

[63] Continuation of Ser. No. 855,916, Mar. 23, 1992, abandoned, which is a continuation of Ser. No. 650,467, Feb. 4, 1991, Pat. No. 5,138,829.

[30] Foreign Application Priority Data

Feb. 10, 1990 [JP] Japan ..... 2-029804
Feb. 10, 1990 [JP] Japan ..... 2-029805

[51] Int. Cl.[5] ..... D01H 7/46; D01H 1/42
[52] U.S. Cl. ..... 57/288; 57/290
[58] Field of Search ..... 57/282, 284, 287, 288, 57/290; 28/240, 249, 258; 219/388

[56] References Cited

U.S. PATENT DOCUMENTS 3,506,804 4/1970 Schippers et al. ..... 28/240 X
3,559,965 2/1971 Ishida ..... 219/388 X
3,722,462 3/1973 Pohler et al. ..... 219/388 X
3,949,544 4/1976 Kitazawa et al. ..... 57/284
4,236,323 12/1980 Dammann et al. ..... 57/284 X
4,295,033 10/1981 Lindgren et al. ..... 219/388
4,534,164 8/1985 Toshimasa et al. ..... 57/282 X
4,567,721 2/1986 Kuroda et al. ..... 57/284
4,918,914 4/1990 Eaton ..... 57/284 X
5,138,829 8/1992 Tanae et al. ..... 57/288

FOREIGN PATENT DOCUMENTS 332227 9/1989 European Pat. Off. ..... 57/284
54-131059 10/1979 Japan .

*Primary Examiner*—Daniel P. Stodola
*Assistant Examiner*—Michael R. Mansen
*Attorney, Agent, or Firm*—Rothwell, Figg, Ernst & Kurz

[57] ABSTRACT

An apparatus for heat treating a synthetic yarn comprises a heater body for completely or partially encircling the synthetic yarn, which is being false twisted or being drawn and false twisted, in a non-contacting condition therewith, a heating member disposed in the heater body for heating the heating wall of the heater body at a high temperature, and yarn guides disposed in a yarn passage surrounded by the heating wall of the heater body. In a first embodiment, the heater body and the heating member are longitudinally divided into at least two sections. In a second embodiment, the yarn guides are provided with yarn guide heating members which are different from the heating member for the heater body.

5 Claims, 4 Drawing Sheets

APPARATUS FOR HEAT TREATING SYNTHETIC YARN

This is a continuation of application Ser. No. 07/855,916, filed Mar. 23, 1992, now abandoned, which is a continuation of application Ser. No. 07/650,467, filed Feb. 4, 1991, now U.S. Pat. No. 5,138,829.

BACKGROUND OF THE INVENTION

The present invention relates to an apparatus for heat treating a synthetic yarn, such as polyester or polyamide, and especially relates to, but not limited to, an apparatus for heat treating a synthetic yarn which apparatus is installed in a textile machine for false-twisting or drawing and false-twisting the synthetic yarn.

More specifically, the present invention relates to a heat treating apparatus which is suitable for a so called first heater which heat sets twists imparted to a synthetic yarn by a false-twisting device and running back along the synthetic yarn.

In order to enhance the productivity of a false twisting machine or a draw and false twisting machine, it has been proposed to enhance the temperature of a heat treating apparatus for heating set false twists imparted to a synthetic yarn to at least 300° C. (see Japanese Patent Application Laid-open No. Sho 55-16936 or Japanese Patent Application Laid-open No. Sho 57-66145).

Conventionally, when a synthetic yarn is heat treated, i.e., false twists are heat set in a twisting machine or a draw and false twisting machine, a heat treating apparatus of a non-contacting type, wherein the yarn is not directly in contact with the heating member and is passed through a yarn path surrounded by a heating wall, is widely used since the resistance to the imparted false twists is small in such a non-contacting type heat treating apparatus.

However, in such a non-contacting type heat treating apparatus, there are problems that twists are not fully run back along the yarn since the yarn creates vibration or ballooning in the heat treating apparatus, that heat is not transferred well to the yarn since the yarn becomes unstable due to the vibration and that the yarn quality is deteriorated.

The above-described problems become remarkable as the yarn treating speed increases, and therefore, these are the reason why high speed treatment is difficult.

Japanese Utility Model Publication No. Sho 61-42937 discloses an apparatus for heat treating a synthetic yarn at a high temperature more than 300° C. which is provided with yarn path limiting guides by which the yarn is guided along an arc path in order to provide a non-contacting type yarn heating apparatus by which contact of yarn with heating wall due to the ballooning or vibration is prevented and decrease of heat efficiency due to wind loss is prevented.

However, when the temperature of the heater is set at a temperature higher than the melting point of a yarn, for example, of polyester or of polyamide, to be treated but lower than 400° C., during heat treatment of the yarn, the yarn may remain within the heater if the yarn is broken during the yarn treatment, and the remained yarn may be melted and may adhere to the yarn path limiting guides which are disposed within the heater. The melted and adhered material is referred to as "adhesive" hereinbelow in the present specification.

It takes a lot of time until the adhesive is vaporized, in other words, until it changes into a non-liquid state, if the set temperature of a heater is lower than 400° C. Further, if a yarn is threaded again before the adhesive has been vaporized, the material in a liquid state, which is at a high temperature and which has a large heat capacity, adheres to the traveling yarn. Thus, the re-threaded yarn is melted and is broken. Accordingly, it is impossible to thread again while the adhesive in a liquid state is observed on the yarn path limiting guides.

Although the adhesive can be easily removed if an appropriate cleaning article is used, it is a very troublesome operation to manually remove the adhesive from a heater which is heated at a high temperature depending on the locations where the yarn path limiting guides are disposed.

Further, when a false twisted yarn is heat treated at a high temperature, it is usual to set the temperature of the heater so that the temperature of the exit of the heater is equal to a temperature which is required for the yarn. The set temperature of a heater is determined taking into consideration various conditions, such as a yarn speed, yarn thickness (denier), the length of the heater. In this case, it is necessary to set the heater temperature lower than 400° C. depending on the treating conditions. Thus, as described above, there may occur a problem that threading cannot be performed for a long time after breakage of the yarn.

Contrary to this, it has been observed that, for example, in case of polyester yarn, the yarn quality of the obtained yarn is deteriorated, i.e., the crimp characteristic is poor, when the treating time at a high temperature is less than 0.035 min. In other words, it is necessary to heat treat the yarn for a certain time. Accordingly, it cannot be accepted to treat the yarn at an excessively high temperature so that the temperature of the exit of the heater is enhanced while the length of a heater is shortened.

In addition, in a conventional false twisting machine or a draw texturing machine, the length of the heater is set constant in accordance with the machine specification. As described above, the heater length is constant in a conventional machine, and accordingly, the region wherein the treating conditions can be varied is narrow. Thus, the treating conditions, under which the above described disadvantages do not occur, are in a very narrow region.

According to the investigations conducted by the inventors of the present invention, when, for example, a polyester filament yarn was treated, the time which was needed before removal of adhesive depended on the temperatures of the heater as set forth below.

When the temperature of the heater was 370° C., it took about 60 minutes;

450° C., about 2 minutes; and

500° C., about 10 seconds.

Consequently, it has been observed that when the temperature of the heater is set higher than 400° C., the yarn adhered to the yarn path limiting guides can be vaporized in a short time and thus a heater having a self cleaning characteristic can be obtained.

OBJECTS OF THE INVENTION

It is an object of the present invention to provide a heat treating apparatus by which the above-described disadvantages inherent to the conventional apparatuses can be overcome.

It is another object of the present invention to provide a heat treating apparatus by which the disadvantage that threading operation cannot be done for a long time upon yarn breakage can be obviated.

It is a still other object of the present invention to provide a heat treating apparatus which can be cleaned by itself and can be threaded in a short time after yarn breakage without necessity of manual cleaning.

It is a further object of the present invention to provide a heat treating apparatus of a yarn by which wide treating conditions can be realized.

SUMMARY OF THE INVENTION

According to a first aspect of the present invention, the above-described object is achieved by an apparatus for heat treating a synthetic yarn which comprises:

a heater body for completely or partially encircling the synthetic yarn, which is being false twisted or being drawn and false twisted, in a condition non-contacting therewith;

a heating member disposed in the heater body for heating the heating wall of the heater body at a high temperature; and yarn guides disposed in a yarn passage surrounded by the heating wall of the heater body, characterized in that the heater body and the heating member are longitudinally divided into at least two sections.

According to the present invention, it is preferred that the heating members are electric heaters which are connected to a controller for independently controlling heating of the electric heaters, as illustrated in the embodiment. A sheathed heater which will be explained with reference to the embodiment or a plate heater may be used as the electric heaters.

In the present invention of the above-described first aspect, the heater body and the heating member are longitudinally divided into at least two sections. When a thick yarn, i.e., a yarn having a large denier, is heat treated at a high speed, both the divided heating members are simultaneously heated so that the yarn guides disposed in both the divided heating members are heated over 400° C.

When the amounts of exothermic heat per a unit length of both the heating members, i.e., the sheathed heaters in the embodiment, are identical, only one temperature sensor may be disposed for either one of the heating members.

As the thickness of the yarn is decreased or as the treating speed is lowered, the control is altered so that only one of the heating members is heated.

Further, if the heating members, i.e., the sheathed heaters in the embodiment, are so constructed that they are separately heated, it is possible to construct a heating apparatus wherein the various temperatures are set along the direction of yarn travel. In this case, it is preferred that the lengths of the divided heater bodies are different so that the ratio of the heated heater length to the total heater length can be changed and so that the applicable range can be widened.

In addition, the heating members may be installed within the yarn guides projecting from the heater member. Also in this case, according to this aspect of the present invention, the heater body and the heating member are longitudinally divided into at least two.

According to another aspect of the present invention, the above-described object is achieved by an apparatus for heat treating a synthetic yarn which comprises:

a heater body for completely or partially encircling the synthetic yarn, which is being false twisted or being drawn and false twisted, in a condition non-contacting therewith;

a heating member disposed in the heater body for heating the heating wall of the heater body at a high temperature; and yarn guides disposed in a yarn passage surrounded by the heating wall of the heater body, characterized in that the yarn guides are provided with yarn guide heating members which are different from the heating member for heater body.

In this aspect of the present invention, the heater body is provided with the yarn guides which are heated by themselves. Further, in addition to the control system of the heater body, the yarn guide is provided with a yarn guide heating member so that each yarn guide is always maintained at a temperature higher than 400° C., more preferably higher than 450° C. or so that the yarn guide is heated to a high temperature which is about 600° C. in a short time by supplying electric current to the yarn guide heating member disposed in the yarn guide by means of switching operation upon breakage of the yarn, so as to remove the adhesive in a short time when yarn breakage occurs.

BRIEF DESCRIPTION OF THE DRAWINGS

Some embodiments of the present invention will now be explained with reference to the accompanying drawings, wherein.

DETAILED DESCRIPTION OF THE EMBODIMENTS

Figure 4:
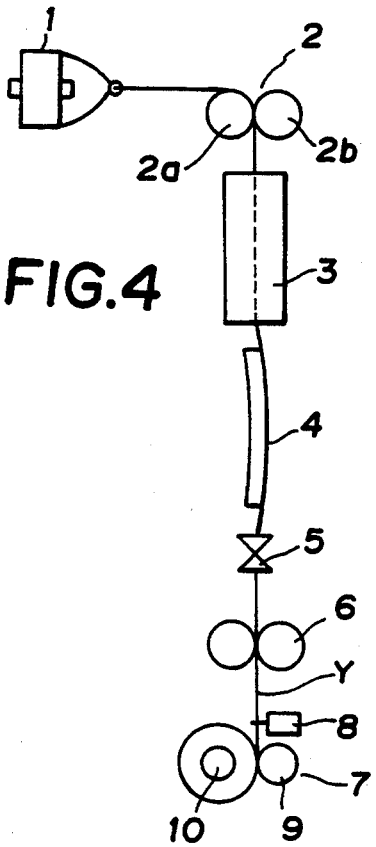
FIG. 4 is a schematic elevation of a draw texturing machine provided with a heating apparatus according to the present invention.

FIG. 4 is a schematic elevation of a draw texturing machine provided with a heating apparatus according to the present invention.

A yarn Y is withdrawn from a supply yarn 1 by means of first feed rollers 2, which comprise a pair of rollers 2*a* and 2*b*. The withdrawn yarn Y is drawn at a predetermined draw ratio between the first feed rollers 2 and second feed rollers 6, and at the same time twists are imparted to the yarn Y by means of a conventionally known twisting device 5, such as friction belts, friction discs or a false twisting spindle. Instead of the false twisting operation being carried out simultaneously with the drawing operation, the false twisting operation may be performed after the drawing operation.

Twists, which have been imparted to the yarn Y by means of the twisting device 5, run back toward the first feed rollers 2 along the yarn Y. The twists running back along the yarn Y are heat set by a heat treating apparatus 3, and then, the yarn Y is cooled in a stabilizing track 4 disposed below the heat treating apparatus 3.

As described above, between the first feed rollers 2 and the second feed rollers 6, false twists are imparted to the yarn Y located upstream from the twisting device 5, and the yarn Y is de-twisted after it passes through the twisting device 5, and then the yarn Y is fed to a take up device 7 from the second feed rollers 6.

The take up device 7 comprises a traverse device 8, which traverses the yarn Y to and fro, a bobbin holder 10, onto which a bobbin for winding the yarn Y is inserted, and a friction roller 9, which is pressed to the bobbin or the yarn layer wound on the bobbin so as to rotate the bobbin.

The construction of the first embodiment of an apparatus for heat treating a synthetic yarn according to the present invention will now be explained in detail with reference to FIGS. 1 to 3.

Figure 1:
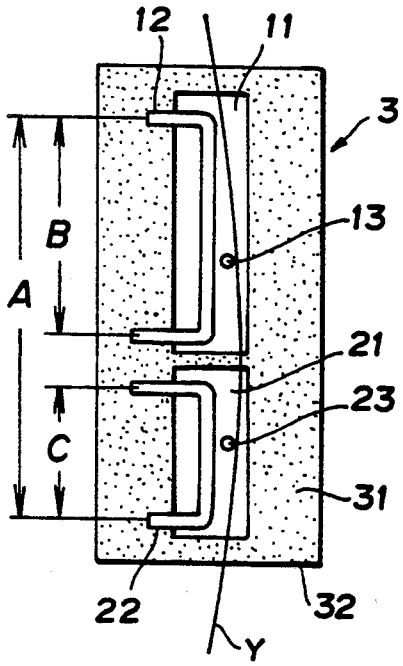
FIG. 1 is a longitudinal sectional view of the first embodiment of the present invention.

As clearly illustrated in FIG. 1, the heater body and the heating member, i.e., sheathed heater in this embodiment, are divided into two sections in the longitudinal direction in the heat treating apparatus 3 of the present embodiment. The heating member is not limited to the above-described sheathed heater and may be any conventionally known heater, such as a plate heater, other than the sheathed heater.

More specifically, the heater body is divided into two heater body pieces 11 and 21 in a longitudinal direction thereof, and the sheathed heaters 12 and 22 are mounted in the two heater body pieces 11 and 21, respectively, in order to heat the two heater body pieces 11 and 21, respectively. Reference numerals 13 and 23 denote a sensor for detecting temperature.

Both the sheathed heaters 12 and 22, may be simultaneously heated as indicated by an arrow A in FIG. 1. In some cases, one of the sheathed heaters 12 and 22, i.e., only the sheathed heater 12 as indicated by an arrow B in FIG. 1 or only the sheathed heater 22 as indicated by an arrow C, may be mainly heated. Further, the heating conditions for the sheathed heaters 12 and 22 may be different. The setting of the heating conditions is done by means of a controller (not shown).

Figure 9:
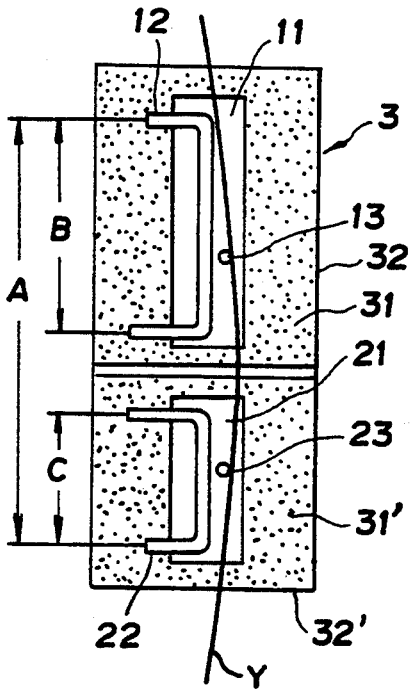
FIG. 9 is a longitudinal sectional view of another embodiment similar to that illustrated in FIG. 1.

In FIG. 1, the outer surfaces of the heater body pieces 11 and 21 are surrounded by a common heat insulator 31 which is in turn coated by a common insulator cover 32. As illustrated in FIG. 9, which is another embodiment similar to that illustrated in FIG. 1, not only the heater bodies 11 and 21 and the heating members 12 and 22 but also the insulators 31 and 31' and the insulator covers 32 and 32' which surround the heater bodies 11 and 21 and the heating members 12 and 22, may be divided.

Figure 2:
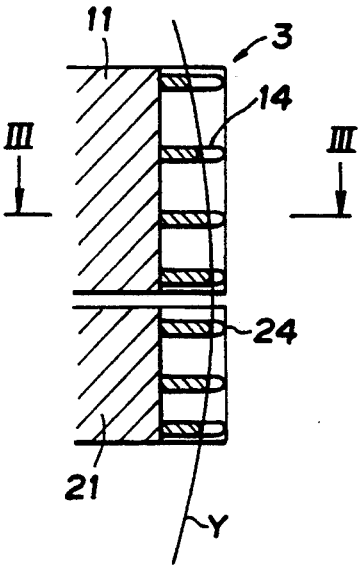
FIG. 2 is a schematic side view of the hester illustrated in FIG. 1.

As illustrated in FIG. 2, a plurality of yarn guides 14 and 24 project from the heater body pieces 11 and 21 and are spaced in a yarn traveling direction.

Figure 3:
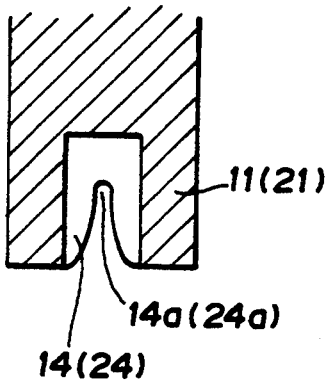
FIG. 3 is a cross sectional view along line III—III in FIG. 2.

The yarn guides 14 and 24 have recesses **14*a* and 24*a* formed at positions corresponding to the yarn path as illustrated in FIG. 3. It is preferred that an imaginary line connecting the bottoms, where the yarn Y travels, of the recesses 14*a* and 24*a*** form a slight arc so that ballooning of the yarn Y is prevented.

Further, it is preferred that the material of the heater body pieces be copper alloy.

As described above, the temperature of the heat treating apparatus 3 is basically set so that the yarn temperature at the exit of the heat treating apparatus 3 is about 220° C. in case of polyester yarn. The yarn temperature depends on the heater length, the yarn speed, yarn thickness, i.e., denier, and the set heater temperature. For example, cases for polyester yarns of 150 and 75 denier, which denier is measured in the obtained textured yarns, will now be explained.

In the embodiment, the heater body piece 11 located upstream has a length of 0.7 m, the heater body piece 21 located downstream has a length of 0.3 m, and accordingly, total length of the heater is 1 m.

(1) In case of a yarn of 150 denier

Figure 5:
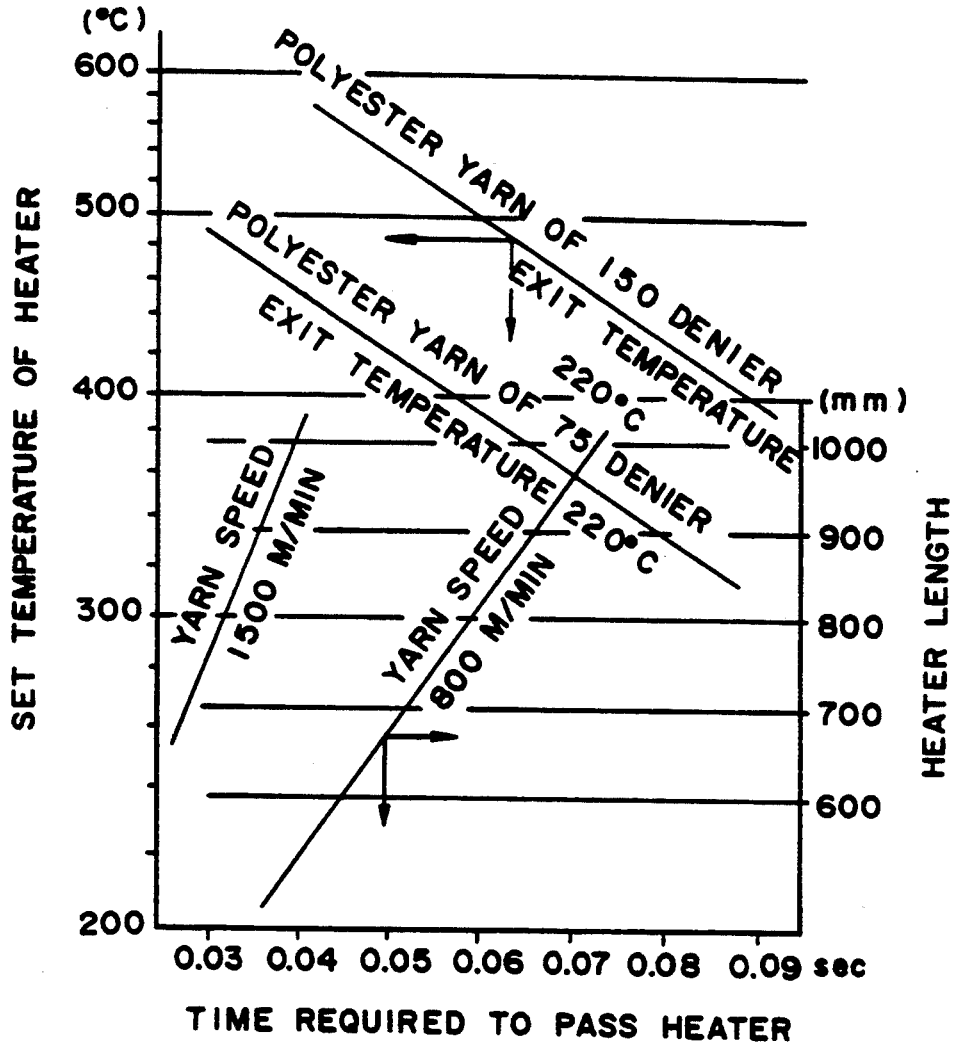
FIG. 5 is a diagram illustrating the relationship between the set temperatures of a heater and the temperatures of yarns measured at the exit of the heater.

When both the divided heater body pieces 11 and 21 are simultaneously heated, times needed for a yarn to pass through the heater having a total length of 1 m are read for the yarn speeds of 800 and 1500 m/min from the lower part of FIG. 5, and then the heater temperatures, which are required by the yarn of 150 denier to be heated to 220° C. at the exit of the heater after it is heated in the heater for the times obtained above, are read from the upper part of FIG. 5.

In conclusion, in order to ensure the yarn temperature at the exit of the heater to be 220° C., the temperatures of the heater are required to be set between 456° and 582° C. for a yarn having 150 denier and traveling between 800 and 1500 m/min.

Thus, when the yarn is adhered to the yarn guide or yarn guides upon its breakage, the adhesive disappears in a short time since the temperature of the yarn guides is high, i.e., higher than 400° C., and the yarn guides are cleaned by themselves. Accordingly, it is possible for an operator to thread again after short stoppage.

(2) In case of a yarn of 75 denier

When the heater length is 1 m, i.e., both the divided heater body pieces are simultaneously heated, the heater temperatures are required to be set between 355° and 455° C. for a yarn having 75 denier and traveling between 800 and 1500 m/min so that the yarn temperature at the exit of the heater is 220° C. In short, the temperature of the yarn guides, i.e., the set temperature of the heater, becomes lower than 400° C. for the yarn speed less than about 1050 m/min, and the yarn, which has once adhered to the yarn guides, remains on the yarn guides for a long time in a melted state. Accordingly, even if the threading operation is tried again, the threading success ratio becomes very low. In other words, the operator can scarcely succeed in such a threading operation.

In order to increase the threading success ratio, when only the heater having a length of 0.7 m is heated among the two heaters, i.e., the heaters of 0.7 m and 0.3 m in the embodiment, while the remaining heater having a length of 0.3 m is kept unheated, the temperature required to be set for the heated heater is between 410° and 500° C. for the above-described yarn speed range. Accordingly, the heater has a self cleaning capability.

(3) Further, when a thin yarn is heat treated, the following uses are possible since the heater body and the heating members are divided into two portions.

While the heater having a length of 0.7 m is kept at a temperature at which yarn does not melt or adhere to the heater, the remaining heater having a length of 0.3 m is heated to a temperature higher than 400° C. Thus, the temperature of the yarn at the exit of the heater is maintained at about 220° C.

The results obtained by heat treating a yarn under the conditions described above are shown in Table 1.

TABLE 1

| | | | | | | |
|---|---|---|---|---|---|---|
| Yarn Speed (m/min) | 1000 | 1000 | 1000 | | 1000 | |
| Length of Heater (m) | 1.0 | 1.0 | 0.7 | 0.3 | 0.7 | 0.3 |
| Set Temperature (°C.) | 370 | 450 | 450 | OFF | 500 | 500 |
| Supply Yarn (Denier) | 125 | 125 | 125 | | 230 | |
| Time for Passing through Heater (sec) (of High Temperature) | 0.06 | 0.06 | 0.043 | | 0.06 | |
| Temperature (°C.) at Exit of Heater | 220 | 255 | 220 | | 220 | |
| Time needed to Remove Adhesive upon Breakage | Long | Short | Short | | Short | |
| Quality of Obtained Textured Yarn | Good | Poor | Good | | Good | |

Based on the foregoing explanation, the divided heaters of the present embodiment may be heated as follows.

When a thick yarn, i.e., a yarn having a large denier, is heat treated, both the divided heaters are set at a same high temperature.

Contrary to this, when a thin yarn, i.e., a yarn having a small denier, is heat treated, either one of the divided heaters is mainly heated and its temperature is enhanced.

For example, if the temperature of the yarn guides disposed in the heater B is more than 400° C. and if the time needed for the yarn to pass through the heater B is more than 0.035 second, the other heater A is not heated.

Contrary to this, if the time needed for the yarn to pass through the heater B is less than 0.035 second while the temperature of the yarn guides disposed in the heater B is more than 400° C., the temperature of the other heater A is so set that the yarn guides disposed in the heater A reach a temperature lower than 250° C., at which the yarn does not adhere to the yarn guide, and accordingly, total time, which is required by the yarn to pass through the entire heaters, is increased.

When heat treatment is done at a temperature higher than 400° C., more preferably higher than 450° C., in the false twisting treatment or draw false twisting treatment of a polyester yarn in accordance with the present invention, should the yarn adhere to the yarn guides upon breakage of the yarn, the adhesive is vaporized by the heat in a short time. Thus, the surfaces of the yarn guides recover their original conditions, and accordingly, the threading operation can be readily carried out.

There are various kinds of yarns to be heat treated in false twisting machines or draw texturing machines, and the acceptable range of treating speeds is very wide depending on the required yarn quality. Under such conditions, the heat treating apparatus of the present invention can realize a heater provided with self cleaning capability under wide conditions.

According to the present invention, manual cleaning of the heater can be omitted, and accordingly the design of the heater is free from manual cleaning operation. Therefore, the equipment becomes simple and the cost can be low since it is unnecessary for a designer to take into consideration the easiness of manual cleaning at the positions where the heaters are installed in a false twisting machine or a draw texturing machine.

Figure 10:
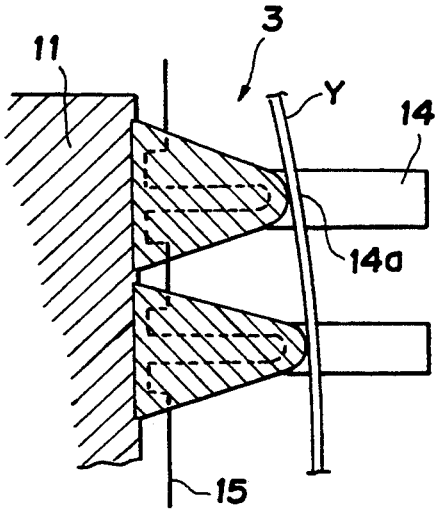
FIG. 10 is a schematic side view of another heater similar to that illustrated in FIG. 2.

In the foregoing embodiments, the heating member is disposed within the heater body 11 which is provided with yarn guides, according to the present invention, and as illustrated in FIG. 10, the heating members may be disposed within the yarn guides which are mounted on the heater body and the heater body may have no heating members mounted therein.

Another embodiment of the heat treating apparatus of the present invention will now be explained with reference to FIGS. 6 to 8.

Figure 8:
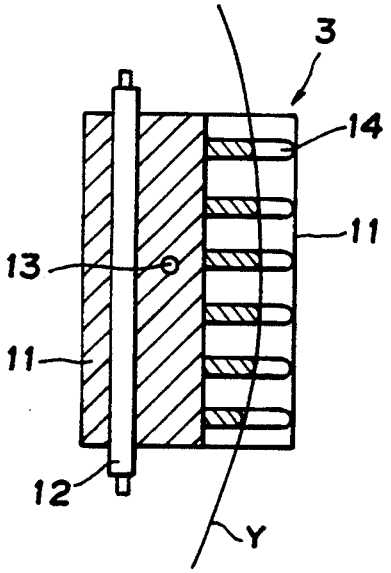
FIG. 8 is a longitudinal sectional view of an embodiment of the present invention wherein some parts are omitted.

As illustrated in FIG. 8, the heat treating apparatus 3 of the present embodiment also comprises a heater body 11 and a heating member, i.e., a sheathed heater 12 in the present embodiment, mounted within the heater body 11.

The heater body 11 and the heating member 12 may be divided into two or more than two sections in the longitudinal direction in the heat treating apparatus similar to the above-described embodiment, and the divided heater bodies and the heating members may be simultaneously or independently heated.

The heater body 11 has a sensor 13 (see FIGS. 7 and 8) of a conventionally known type for detecting a temperature disposed at a suitable position thereof.

Figure 6:
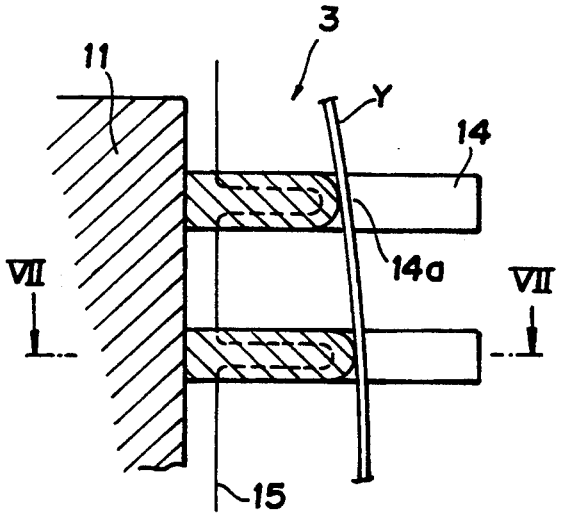
FIG. 6 is an enlarged view of an embodiment of the present invention.

As illustrated in FIGS. 6 and 8, a plurality of yarn guides 14 project from the heater body 11 and are spaced in a yarn traveling direction.

Figure 7:
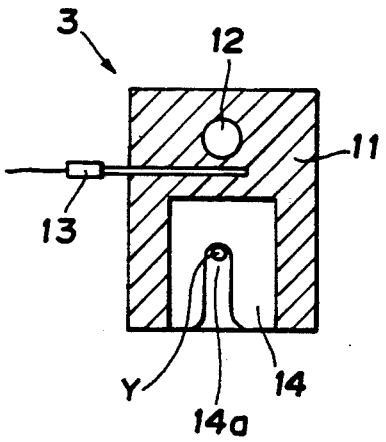
FIG. 7 is a cross sectional view along line VII—VII in FIG. 6.

The yarn guides 14 have recesses **14*a* formed at positions corresponding to the yarn path as illustrated in FIG. 7. It is preferred that an imaginary line connecting the bottoms, where the yarn Y travels, of the recesses 14*a*** form a slight arc so that ballooning of the yarn Y is prevented.

Further, it is preferred that the material of the heater body pieces be copper alloy.

As illustrated in an enlarged scale in FIG. 6, yarn guide heating members 15, i.e., illustrated by a wire in the present embodiment, are disposed within the yarn guides 14, and the yarn guide heating members 15 are heated independently from the heating member 12 which heats the heater body 11. Illustration of the yarn guide heating member 15 is omitted in FIG. 8.

The heat from the heater body 11 is transferred to the yarn Y through the air layer of high temperature near the surface of the heater body 11.

The temperature of the heater body 11 may be set at a temperature lower than 400° C., for example 320° C., depending on the treating conditions of the yarn. In such a case, as described above, the yarn may be adhered to the yarn guides upon its breakage in a conventional apparatus, and the threading operation cannot be carried out.

However, according to the present embodiment, when the yarn guide heating members 15 are always heated so that the temperature of the yarn guides 14 is always kept at a temperature between 400° and 600° C., if the yarn is adhered to the yarn guides 14 upon its breakage, the adhered yarn is removed in a short time by means of the heat of the yarn guides 14.

It is preferred that the yarn guides 14 are heated to a high temperature, which is about 600° C., in a short time after occurrence of yarn breakage by supplying electric current into the yarn guides 14 by means of switching operation so that the adhesive created upon yarn breakage is removed. According to this method, when the yarn breakage occurs, the yarn guides are heated by means of the switching operation before the re-threading operation and the adhesive is easily removed. Accordingly, the yarn can be threaded again. Further, although the yarn guides are temporarily heated to a high temperature, i.e., about 600° C., the yarn guides recover the original condition in a short time since the heat capacity of the yarn guides is small, and the yarn guides do not substantially adversely influence upon the re-threaded yarn.

An attempt is also possible to temporarily enhance the temperature of the heater body 11. However, the heater body 11 has a large heat capacity and requires a long time until it reaches in a thermally stable state after it has temporary heated. Accordingly, the heater body 11 may adversely affect the yarn quality while its thermal characteristics are unstable. Accordingly, this attempt is not recommended.

The results obtained by heat treating a yarn under the conditions described above are shown in Table 2.

TABLE 2

| | Conventional Method | Example 1 | Example 2 |
|---|---|---|---|
| Yarn Speed (m/min) | 1000 | 1000 | 1000 |
| Length of Heater (m) | 1.0 | 1.0 | 1.0 |
| Set Temperature (°C.) | 370 | 370 | 370 |
| Supply Yarn (Denier) | 125 | 125 | 125 |
| Normal Temperature of Yarn guides (°C.) | 365 | 450 | 365 |
| Temporary Temperature of Yarn guides (°C.) | — | — | 600 |
| Time needed to Remove Adhesive upon Breakage | Long | Short | Temporary |
| Quality of Obtained Textured Yarn | Good | Good | Good |

As described above, when heat treatment is carried out at a temperature higher than 400° C., more preferably higher than 450° C., in the false twisting treatment or draw false twisting treatment of a polyester yarn in accordance with the present invention, should the yarn adhere to the yarn guides upon breakage of the yarn, the adhesive is vaporized by the heat in a short time. Thus, the surfaces of the yarn guides recover their original conditions, and accordingly, threading operation can be readily carried out.

According to the present invention, manual cleaning of the heater can be omitted, and accordingly the design of the heater is free from manual cleaning operation. Therefore, the equipment becomes simple and the cost can be low since it is unnecessary for a designer to take into consideration the easiness of manual cleaning at the positions where the heaters are installed in a false twisting machine or a draw texturing machine.

What is claimed is:

1. Apparatus for heat-treating synthetic yarn in a twisting zone comprising:

a) a single heater member for at least partially encircling synthetic yarn which is being textured by false twisting in a non-contacting manner, b) the heater member being longitudinally divided into at least two sections in the direction of travel of the synthetic yarn, c) a separate heater disposed in each of the sections of the heater member for heating the yarn passing the heater member to a temperature necessary to set twists in the yarn, d) yarn guides disposed in a yarn passage surrounded by a heating wall of the heater member, e) temperature control means for controlling the heaters in the different sections of the heater member separately such that the temperature of each of the separate heaters is independently controlled in accordance with a characteristic of the yarn so as to heat the yarn to a temperature for heat setting the yarn at an exit of the heater member and so as to provide a self-cleaning capability for the apparatus upon breakage of the yarn, f) a cooling means for cooling the yarn leaving the heater member after the yarn has been heated to the heat setting temperature by the heater member, the cooling means being located downstream from the heater member in the direction of yarn travel, and g) false twisting means for twisting the yarn, the false twisting means being located downstream from the cooling means in the direction of yarn travel.

2. Apparatus according to claim 1, wherein each of said separate heaters is made of a copper alloy and said heater member is surrounded by a common heat insulator extending in a longitudinal direction.

3. A method of preventing adhesive yarn material build-up on yarn breakage in a draw texturing process, the draw texturing process including steps of feeding yarn, imparting twists to the yarn fed by the feeding step, heating the twisted yarn to a heat setting temperature, and cooling the heated yarn just after the heating step, the heating step being effected by a heater member having yarn guides and being located between feeding means and cooling means, the heat-treating step comprising:

applying the heat in two different but adjacent areas longitudinally of the yarn in the direction of travel; and independently controlling the temperature of each of the two areas at which the yarn is heated and varying such temperature in accordance with a characteristic of the yarn so as to heat the yarn to a temperature sufficient for heat setting the yarn at the end of heating, the upper range of the temperature of at least one of the two areas being at least sufficient to vaporize any yarn breakage stuck to the heater on breaking of the yarn so as to provide a self-cleaning capability for the apparatus upon breakage of the yarn.

4. Apparatus for heat-treating synthetic yarn in a twisting zone comprising:

a) a heater member for at least partially encircling synthetic yarn which is being textured by false twisting in a non-contacting manner;

b) the heater member being longitudinally divided into at least two sections in the direction of travel of the synthetic yarn;

c) a separate heater disposed in each of the sections of the heater member for heating the yarn passing the heater member to a temperature necessary to set twists in the yarn;

d) yarn guides disposed in a yarn passage surrounded by a heating wall of the heater member;

e) temperature control means for controlling the heaters in the different sections of the heater member separately such that the temperature of each of the separate heaters is independently controlled in accordance with a characteristic of the yarn so as to heat the yarn to a temperature for heat setting the yarn at an exit of the heater member and to provide a self-cleaning capability for the apparatus upon breakage of the yarn;

f) a cooling means for cooling the yarn leaving the heater member after the yarn has been heated to the heat setting temperature by the heater member, the cooling means being located downstream from the heater member in the direction of yarn travel; and g) false twisting means for twisting the yarn, the false twisting means being located downstream from the cooling means in the direction of yarn travel.

5. Apparatus for heat-treating synthetic yarn in a twisting zone comprising:

a) a heater member for at least partially encircling synthetic yarn which is being textured by false twisting in a non-contacting manner;

b) the heater member being longitudinally divided into at least two sections in the direction of travel of the synthetic yarn;

c) a separate heater disposed in each of the sections of the heater member for heating the yarn passing the heater member to a temperature necessary to set twists in the yarn;

d) yarn guides disposed in a yarn passage surrounded by a heating wall of the heater member;

e) temperature control means for controlling the heaters in the different sections of the heater member separately such that the temperature of each of the separate heaters is independently controlled in accordance with a characteristic of the yarn so as to heat the yarn to a temperature for heat setting the yarn at an exit of the heater member;

f) a cooling means for cooling the yarn leaving the heater member after the yarn has been heated to the heat setting temperature by the heater member, the cooling means being located downstream from the heater member in the direction of yarn travel; and g) false twisting means for twisting the yarn, the false twisting means being located downstream from the cooling means in the direction of yarn travel.

* * * * *

UNITED STATES PATENT AND TRADEMARK OFFICE

CERTIFICATE OF CORRECTION

PATENT NO. : 5,353,583

DATED : October 11, 1994

INVENTOR(S) : Fumio Tanae et al.

It is certified that error appears in the above-identified patent and that said Letters Patent is hereby corrected as shown below:

Col. 4, line 16, "the" (second occurrence) should be --each--.

Col. 4, line 33, "hester' should be --heater--.

Signed and Sealed this

Twenty-fifth Day of April, 1995

*Attest:*

Bruce Lehman

BRUCE LEHMAN

*Attesting Officer*

*Commissioner of Patents and Trademarks*